US005669153A

United States Patent [19]

Hood

[11] Patent Number: 5,669,153

[45] Date of Patent: Sep. 23, 1997

[54] BUTT HINGE FASTENER LOCATION MARKING DEVICE

[76] Inventor: Edward D. Hood, 552 Alden Rd., Sellersburg, Ind. 47172

[21] Appl. No.: 663,855

[22] Filed: Jun. 19, 1996

[51] Int. Cl.[6] ..... B25H 7/04

[52] U.S. Cl. ..... 33/667; 33/194; 33/669; 33/678

[58] Field of Search ..... 33/194, 197, 666, 33/667, 669, 677, 678, 679

[56] References Cited

U.S. PATENT DOCUMENTS

| | | | |
|---|---|---|---|
| 956,116 | 4/1910 | Lohman | 33/667 |
| 1,632,824 | 6/1927 | Davidson | 33/197 |
| 1,787,313 | 12/1930 | Houts | 33/197 |
| 2,497,570 | 2/1950 | Abshire | 33/669 |
| 2,812,589 | 11/1957 | Wiediger | 33/667 |
| 2,889,633 | 6/1959 | Simon | 33/667 |
| 3,078,585 | 2/1963 | Dearborn | 33/667 |
| 3,307,268 | 3/1967 | Deacon, Sr. | 33/197 |
| 4,058,902 | 11/1977 | Hall | 33/667 |
| 4,133,114 | 1/1979 | Roach | 33/197 |

FOREIGN PATENT DOCUMENTS

| | | | |
|---|---|---|---|
| 71248 | 7/1950 | Denmark | 33/197 |
| 27892 | 1/1956 | Finland | 33/197 |

*Primary Examiner*—Thomas B. Will
*Attorney, Agent, or Firm*—Maurice L. Miller, Jr.

[57] ABSTRACT

A device for marking the proper position for the threaded fasteners used to secure the leaves of a butt hinge to and between opposable surfaces, which surfaces are to be made hingably movable relative to each other is disclosed. The device includes at least one hinge leaf locator plate which is sized and shaped to conform to the leaf of a hinge whose fastener positions are to be marked. The locator plate contains a series of sharp pointed pins which are arranged thereon and spaced apart from one another in the same manner as the centerline of the fastener holes located in the leaves of the hinge which is to be mounted to and between the opposable surfaces. The series of pins have pointed end portions which project in opposite directions from the locator plate to permit marking by impressions of the pin heads on both opposable surfaces simultaneously for maximum accuracy. The device also includes a backing member having a flat backing surface which is adapted to rest against a surface which is perpendicular to one of the opposable surfaces being marked to provide accurate alignment for the fasteners of both hinge leaves. The device may have more than one locator plate attached to the backing member and the plates may be adjustable to bring any desired one of them from a storage position to an operative position.

9 Claims, 2 Drawing Sheets

BUTT HINGE FASTENER LOCATION MARKING DEVICE

BACKGROUND OF THE INVENTION

This invention relates to a device for marking the proper location for threaded fasteners used to secure the leaves or plates of a butt hinge to and between opposable surfaces, which surfaces are to be made hingably movable relative to one another.

Broadly speaking, such devices, templates or instruments are known in the prior art. See, for example, U.S. Pat. No. 4,133,114 issued to C. L. Roach on Jan. 9, 1979; U.S. Pat. No. 4,998,355 issued to T. R. Greene on Mar. 12, 1991; U.S. Pat. No. 4,058,902 issued to R. W. Hall on Nov. 22, 1977; and U.S. Pat. No. 4,873,769 issued to A. J. Casanove on Oct. 17, 1989.

The device disclosed in the Roach patent utilizes a conventional butt hinge having a backing plate attached to one of the leaves of the hinge. The backing plate contains an array of studs having pointed ends which project through fastener holes in the leaf to which the backing plate is attached. The other hinge leaf is rotated until it rests against the hinge leaf containing the backing, whereupon the pointed studs project through registered holes in both of the hinge leaves. The assembly is then placed in a mortis formed on the edge of a door and a hammer is used to impact the backing plate to cause the pointed ends of the studs to make impressions in the door which represent locations for threaded fasteners for a hinge. A problem with this type of marking device is that it can not be used to mark the positions for fastener holes in opposing surfaces, which are to be made hingably movable relative to one another, simultaneously. That is to say, since the pointed studs of the Roach device only extend in one direction, it is not possible to mark the fastener locations for both leaves of a hinge on opposable surfaces at the same time.

Another difficulty encountered using the device of Roach is that, it does not include a wall backing member for providing a positive stop against the front or back surface of a door or other structure so as to permit setting the precise position of the studs on the adjacent edge of the door or other structure, thus contributing to further inaccuracy in setting the proper location for hinge fasteners.

By means of my invention, these and other difficulties encountered with hinge leaf locating and marking devices of the prior art are substantially eliminated.

SUMMARY OF THE INVENTION

It is an object of the present invention to provide a device for marking the proper location for fasteners used to secure the leaves of a butt hinge to and between opposable surfaces, which surfaces are to be made hingably movable relative to one another.

It is a further object of the present invention to provide such a device which is capable of marking the location of such fasteners on both previously mentioned surfaces simultaneously.

It is another object of the present invention to provide such a device which contains a backing member for placement against a surface adjacent to one of the opposable surfaces for precisely aligning the device for marking of the opposable surfaces.

Briefly, in accordance with my invention, there is provided a locator device for marking the proper position for securing the leaves of a hinge to and between opposable surfaces, which surfaces are to be made hingably movable relative to one another. The device includes at least one hinge leaf locator plate of a preselected size and shape having first and second oppositely facing broad flat surfaces. A backing member is also included which is attached to and which extends from a rear end portion of the locator plate. The backing member contains a broad flat backing surface which extends perpendicular to the oppositely facing surfaces. The backing surface faces a free end of the locator plate. Also included is a first plurality of sharp pins of predetermined spacing and arrangement affixed to the locator plate and extending at right angles from one of said oppositely facing surfaces for marking the location of fasteners for one of two leaves of a hinge. A second plurality of sharp pins of predetermined spacing and arrangement is also provided which is affixed to the locator plate so as to extend at right angles from the other of the oppositely facing surfaces for marking the location of fasteners for another of the two leaves of said hinge.

These and other objects, features and advantages of the present invention will become apparent to those skilled in the art from the following detailed description and attached drawings upon which, by way of example, only the preferred embodiments of my invention are illustrated.

DESCRIPTION OF THE PREFERRED EMBODIMENTS

Figure 1:
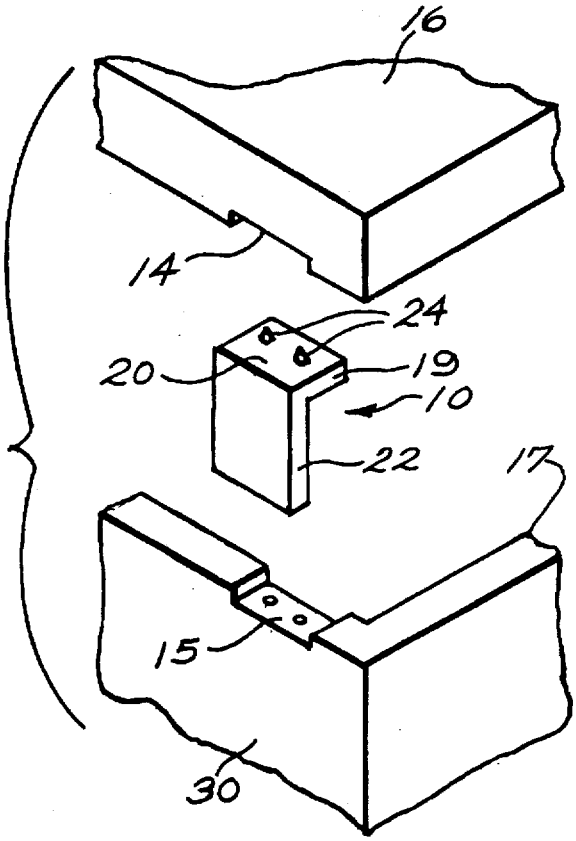
FIG. 1 shows a perspective view of an L-shaped device for marking the proper position for fasteners used to secure the leaves of a conventional butt hinge to and between opposable surfaces of a lid and a rear wall of a receptacle of a conventional jewelry box, thus illustrating a preferred embodiment of my invention.
Figure 3:
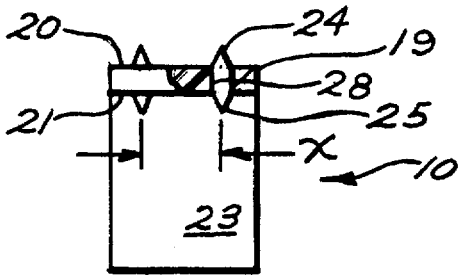
FIG. 3 shows a front elevation view of the device of FIGS. 1–2.
Figure 4:
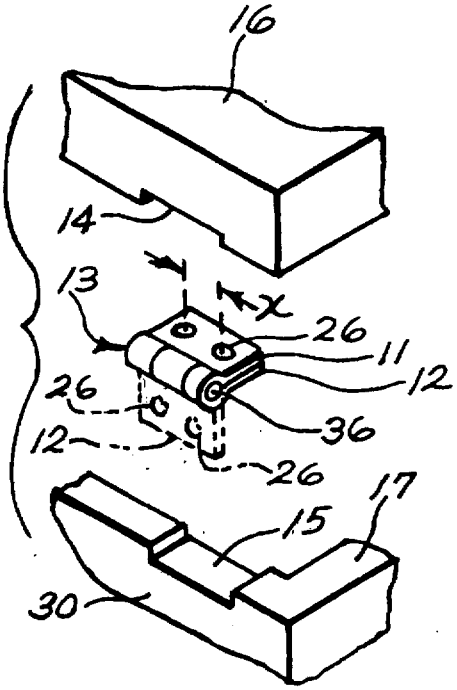
FIG. 4 shows a perspective view of fragments of the lid and receptacle rear wall of FIG. 1 with a conventional butt hinge interposed therebetween in place of the device of FIG. 1.

Referring now to the drawing figures and, in particular, to FIGS. 1–4 there is shown, in one preferred embodiment of my invention, a locating device, generally designated 10 (FIGS. 1–3 only) for marking the proper position of fasteners for securing a pair of leaves 11 and 12 of a conventional butt hinge 13 (FIG. 4 only) to and between opposable surfaces 14–15 of a lid 16 and receptacle 17, respectively, of a jewelry box (FIGS. 1 and 4 only). The device 10 includes a relatively broad flat hinge leaf locator plate 19 having oppositely facing broad flat surfaces 20 and 21. The plate 19 is of preselected size and shape and conforms to the size and shape of each of the leaves 11 and 12 which are to be joined to and between the lid 16 and receptacle 17. The device 10 also includes a wall backing plate or backing member 22 which is attached to one end portion of the locator plate 19. The member 22 contains a relatively broad flat face or surface 23 which extends perpendicular to the surfaces 20 and 21 of the locator plate 19. The surface 23 faces in the same direction in which the locator plate 19 extends from its joinder to the member 22 to its front edge or as measured from its joinder to the connecting means which joins the plate 19 to the member 22, as the case may be.

The device 10 further includes a first and a second pair of sharply pointed pins or pin point portions 24 and 25, respectively which are attached to the plate 19. The pins 24 extend perpendicularly away from the surface 20 while the pins 25 extend perpendicularly away from the surface 21. The pins 24 are ganged and spaced relative to one another on the surface 20 so that their points occupy precisely the same position relative to the plate 19 that the centerlines of a pair of fastener holes 26 occupy in the conforming leaf 11 of the hinge 13 as shown in FIG. 4. Similarly, the pins 25 are arranged and spaced relative to one another on the surface 21 so that their points occupy precisely the same position relative to the plate 19 that the centerlines of the holes 26 occupy in the leaf 12. The holes 26 on the leaf 12 register with the holes 26 of the leaf 11 when the leaves 11 and 12 are placed flush against one another as shown in full in FIG. 4, it being understood that the flat plate portions of the leaves 11, 12 are identical. The holes 26 of the leaf 12 are shown in phantom, as is the leaf 12, when the latter leaf is rotatably separated from the leaf 11.

Figure 2:
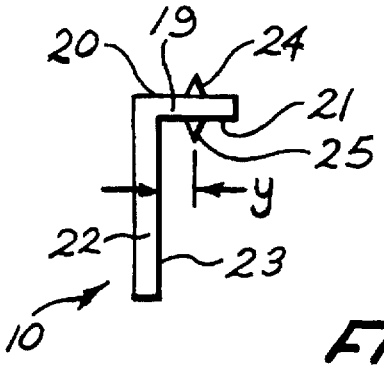
FIG. 2 shows a side elevation view of the device of FIG. 1.

In the present example, one end of the locator plate 19 is integrally connected to one end of the backing member 22 to form an L-shaped device 10 as seen best in FIG. 2. The plate 19 and member 22 may be constructed of any suitable material such as a relatively rigid plastic or steel. The pins 24 may be separate and distinct from the pins 25. In the alternative, the pins 24 may be pointed end portions of two pin elements (FIG. 3 only) which extend through and are press fitted into two holes 28 formed through the plate 19 so as to terminate on the other ends in pointed pin portions 25. I prefer the latter mentioned arrangement because it more readily assures that the pins 24 will be precisely aligned with the pins 25 in all cases, such as the present example, where that is necessary, i.e. where the leaves 11 and 12 of the hinge 13 are identical to one another and where the fastener holes 26 in each of the leaves are registrable and identical with one another.

To use the device 10 to locate the leaves 11 and 12 of the hinge 13, consider the conventional jewelry box as shown in FIGS. 1 and 4 having a lid 16 and a receptacle 17 which are to be made hingably movable relative to one another. As is sometimes the case, mortises are formed on a lower rear edge portion of the lid 16 and on an upper edge portion of a back wall 30 of the receptacle 17. The mortis in the lid 16 should register with the mortis in the wall 30 of the receptacle 17 when the lid 16 is placed in a properly aligned closed position on the receptacle 17. Although only the mortises for a single hinge are shown in FIGS. 1 and 4, which are located on a right rear side portion of the box 18 as viewed, it will be understood that there exists an identical set of mortises for a second hinge identical to the hinge 13 on the opposite side edge portion of the lid 16 and receptacle 17. Moreover, there may also be a third identical set of mortises for a third hinge, identical to the hinge 13, located at the center of the rear edge of the lid 16 and at the center of the rear wall 30 of the receptacle 17. With the lid 16 removed from the receptacle 17, the plate 19 is placed over the mortis in the rear wall 30 as shown and lowered upon the base 15 of that mortis such that the then vertically extending surface 23 of the member 22 as viewed is flush against the rear wall 30 of the receptacle 17. The pins 25 will now rest on the surface 15 where fasteners for the hinge leaf 12 will ultimately be located.

Next, the lid 16 is lowered into proper position on the receptacle 17 such that the base 14 of the lid mortis is directly over the plate 19. Care must be taken to assure that all edges of the lid 16 are aligned with the corresponding walls of the receptacle 17. The lid 16 is then pushed downwardly upon the receptacle 17 such that the pins 24 are impressed into the base 14 and such that the pins 25 are impressed into the base 15 to mark the proper positions for conventional threaded fasteners to be used to fasten the leaves 11 and 12 of the hinge 13 to and between the mortises of the lid 16 and receptacle 17. It will be appreciated that it is not essential to form mortises in the lid 16 and rear wall 30 of the receptacle 17 in order to use the device 10 to properly locate the leaves 11 and 12 of the hinge 13. However, if mortises are not used, then the resulting gap between the lower rear edge of the lid 16 and the upper surface of the wall 30 will necessarily be wider when the lid 16 is closed in order to accommodate a portion of the barrel of the hinge 13 between those two surfaces. The use of mortises will therefore reduce the width of the resulting gap, producing what may be considered a cleaner and, certainly, a closer fit between the opposable rear edge portions of the lid 16 and receptacle 17 when closed against one another.

Figure 5:
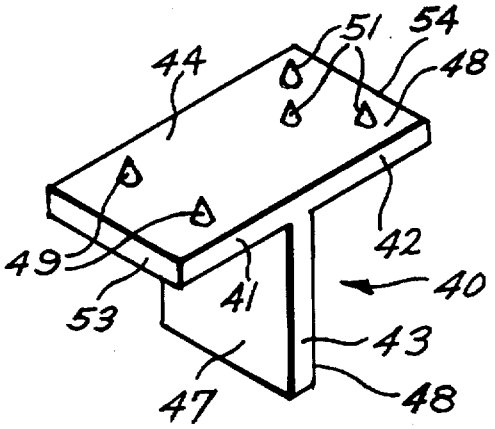
FIG. 5 shows a perspective view of a T-shaped device for marking the proper position for fasteners used to secure the leaves of two different styles of butt hinges between opposable surfaces which are to be made hingably movable relative to each other, thus illustrating another important embodiment of my invention.
Figure 6:
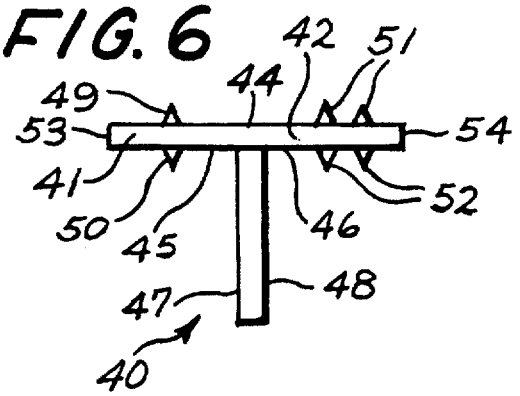
FIG. 6 shows a side elevation view of the device of FIG. 5.

Referring now to FIGS. 5–6 of the drawing figures there is shown, in another important embodiment of my invention, a T-shaped device 40 for marking the proper position for fasteners to be used in securing the leaves of two different styles of conventional butt hinges, not shown, to and between opposable surfaces which are to be made hingably movable relative to one another. The device 40 includes a pair of hinge leaf locator plates 41 and 42 which extend in opposite directions from one another in the same plane and which are joined to one end of a backing plate 43. The plates 41 and 42 contain a first broad flat surface 44, which spans both of them, and a pair of broad flat surfaces 45 and 46, respectively, both of which face in a direction opposite that of the surface 44 and which are separated from one another by the backing plate 43. The plate 43 contains to a pair of oppositely facing broad, flat, backing surfaces 47 and 48 which extend perpendicularly from the surfaces 45, 46, respectively.

The locator plate 41 contains a first pair of pin portions 49 which extend perpendicularly from the surface 44 and a second pair of pin portions 50 which extend perpendicularly from the surface 45 in precise alignment with the pin portions 49. The locator plate 42 contains three pin portions 51 (see FIG. 5) which extend perpendicularly from the surface 44 and three pin portions 52 which extend perpendicularly from the surface 46 and which are precisely aligned with the pin portions 51. The backing surface 47 faces in the same direction as a free edge 53 of the locator plate 41 and the backing surface 48 faces in the same direction as a free edge 54 of the locator plate 42.

The device 40 is used in the same manner as the device 10 of the previous example, except that, in this example, two different styles of hinge leaf can be located between opposable surfaces that are to be hinge connected. For example, to locate a hinge having two fasteners per leaf, as in the case of the hinge 13 of FIG. 4, the locator plate 41 and the backing surface 47 of the device 40 are used in the same manner as the L-shaped device 10 of the previous example. In addition, a different style hinge having three fastener holes disposed in a triangular array, for example, can be located with the device 40 by using the locator plate 42 and the backing surface 48 in the same manner as the device 10. It will be appreciated that the number and arrangement of pins or pin portions, as the case may be, for use on the plates 41 and 42 are a matter of choice depending upon the number and arrangement of fastener holes in the leaves of the hinges for which the locator device 40 is to be used. As in the previous example, the plates 41, 42 and 43 may be constructed of any suitable rigid material such as plastic or steel. The marking pins or pin portions 49–52 may be constructed of any suitable material, such as steel, which can be fashioned into sharp points and which are hard enough to penetrate wood or other material of the type to be used in forming the hingable surfaces to be joined so that hinge leaf fastener locations can be marked.

Figure 7:
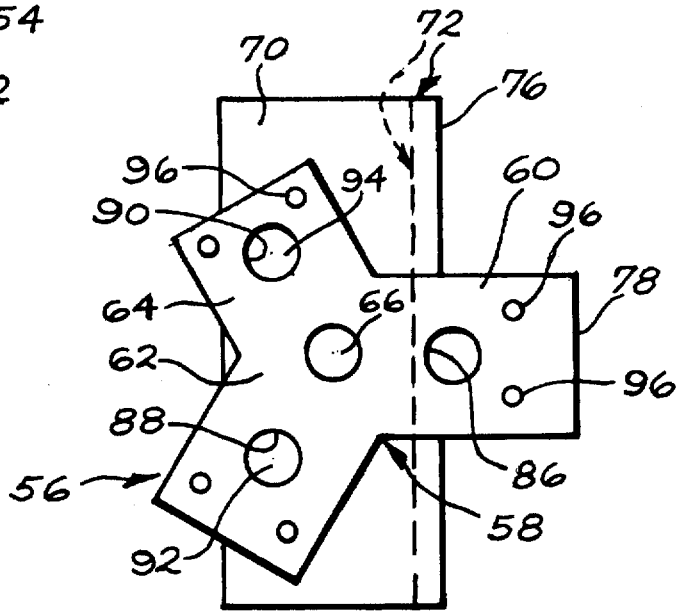
FIG. 7 shows a top plan view of an adjustable device for marking the proper position for fasteners for securing the leaves of up to three different sizes of conventional butt hinges to and between opposable surfaces which are to be made hingably movable relative to each other, thus illustrating yet another important embodiment of my invention.
Figure 8:
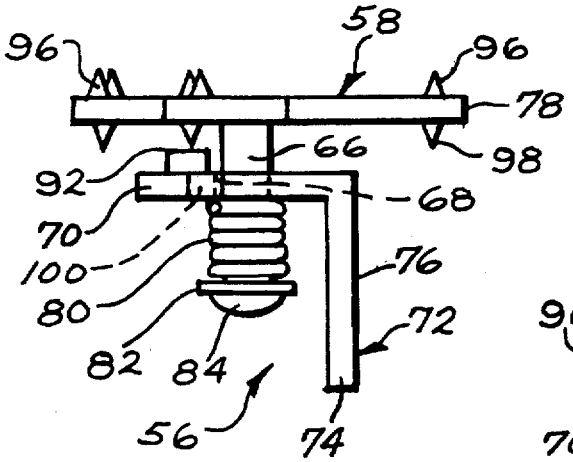
FIG. 8 shows a side elevation view of the device of FIG. 7 having a rotatable table and a wall backing member, the table and member being spaced apart for rotating one relative to the other.
Figure 9:
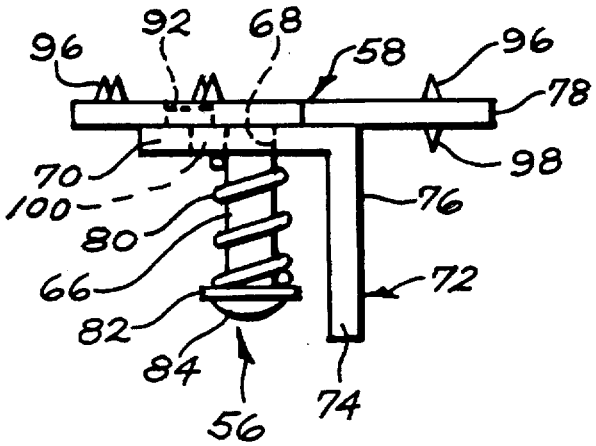
FIG. 9 shows a side elevation view of the device of FIGS. 7–8, the same as viewed in FIG. 8 except that, in this view, the table and member lie flush against one another in an operative condition.

Referring now to FIGS. 7–9 there is shown, in another important embodiment of my invention, an adjustable locating device, generally designated 56, for marking the proper positions of fasteners used for securing the leaves of up to three different sizes of conventional butt hinges to opposable surfaces which are to be made hingably movable relative to one another. The device 56 includes a relatively flat locator table, shown generally by an arrowed leader line marked 58, which table comprises three different length locator plates 60, 62 and 64 which lie in a single plane and which are rotationally displaced from one another by approximately 120 degrees of arc (see FIG. 7). The table 58 is fixedly attached at its center to one end of a pivot pin 66. The pin 66 is rotationally and longitudinally movable through a hole 68 formed in a flange 70 of an angle bracket 72. The bracket 72 also contains a backing plate 74 which extends perpendicularly from the flange 70. The plate 74 includes a broad flat wall backing surface 76 which faces in the same direction as an outer free edge 78 of the plate 60 so long as the plate 60 is in an operative position as shown.

The pin 66 is surrounded by a coiled spring 80 which is confined between a shoulder 82 of an end cap 84 of the pin 66 and an opposing side of the flange 70. The spring 80 thus biases the flange 70 against the plate 58 as shown in FIG. 9 which is the operative condition of the device 56. Each of the plates 60, 62 and 64 contain a circular opening 86, 88 and 90, respectively, which is adapted to receive either one of two cylindrically shaped locator tabs 92 and 94 therein when that particular plate is in an inoperative, stored position. In the present example the plate 60 is disposed in the operative position relative to the wall backing surface 76 while the plates 62 and 64 are disposed in their stored positions. Accordingly, in the present example, the tabs 92 and 94, which are attached to an upper surface, as viewed, of the flange 70 are inserted within the holes 88 and 90 respectively of the stored plates 62 and 64. When the plate 60 is moved to a stored position, such as for example, that occupied by the plate 62 in the drawings, the tab 92 will become inserted into the hole 86, the plate 62 will become rotated to the position now occupied by the plate 64, wherein the tab 94 will become inserted in the hole 88, and the plate 64 will be moved to the operative position now occupied by the plate 60. If desired, the plates 60, 62 and 64 can be suitably aligned using only one of the tabs 92 or 94 to fit one of the openings 86, 88 or 90.

As in the previous examples, the plates 60, 62 and 64 contain sharp pointed pins or pin portions 96 on upper surfaces thereof, as viewed, and pin portions 98 on lower surfaces thereof. I recommend that the pin portions 96 and 98 extend about 1/16 inch above and below the table 58, which is sufficient for marking the centerlines for threaded fasteners used with the leaves of butt hinges without damaging the wood in which the fasteners will be inserted in most cases. Thus, the tabs 92 and 94 should extend above the upper surface of the flange 70 by at least this amount and, preferably, twice this amount or about 1/8 inch so that, when the table 58 is lifted off of the flange 70, as in FIG. 8, preparatory to turning the table, it will be necessary to lift it above the tabs 92 and 94 to turn it such that the pins 98 will not scrape the upper surface of the flange 70.

Notice that the plates 60, 62 and 64 are of different lengths as measured from their free ends to the longitudinal centerline of the pin 66. This permits each of the subject plates to be used to locate the fasteners for different size leaves of three different size butt hinges. The number, spacing and/or arrangement of pins or pin portions on each of the plates 60, 62 and 64 can also be different from one another to permit the device 56 to be used in locating the fastener positions for leaves of up to three different sizes and/or styles of butt hinges. When the table 58 is disposed flush against the flange 70 one of the two pins 98 in two of the plates 60, 62 and 64 which are located in the inoperative, stored position will be over the flange 70 as best seen in FIG. 7. Accordingly, a pair of holes 100 (FIGS. 8–9) are drilled through the flange 70 to accommodate these pins when the stored locator plates are properly positioned with the tabs 92 and 94 inserted in the holes therein.

Although the subject invention has been described with respect to specific details of certain preferred and, otherwise, important embodiments thereof, it is not intended that such details limit the scope and coverage of this patent other than as is specifically set forth in the following claims.

I claim:

1. A locator device for marking the proper position for securing the leaves of a hinge to and between opposable surfaces, which surfaces are to be made hingably movable relative to one another, said device comprising at least one hinge leaf locator plate of a preselected size and shape having first and a second oppositely facing broad, flat surfaces, a backing member attached to and extending at a right angle from a rear end portion of said locator plate, said backing member having a broad flat backing surface which extends perpendicular to the oppositely facing surfaces, said backing surface facing a free end of said locator plate, a first plurality of sharp pins of predetermined spacing and arrangement affixed to said locator plate and extending at right angles from one of said oppositely facing surfaces for marking the location of fasteners for one of two leaves of a hinge, a second plurality of sharp pins of predetermined spacing and arrangement affixed to said locator plate and extending at right angles from the other of said oppositely facing surfaces for marking the location of fasteners for another of the two leaves of said hinge, a second locator plate having two oppositely facing broad, flat surfaces, a first series of sharp pins of predetermined spacing and arrangement affixed to said second locator plate and extending at right angles from one of said second plate surfaces, and a second series of sharp pins of predetermined spacing and arrangement affixed to said second locator plate and extending at right angles from another of said second plate surfaces, one end of said second locator plate being attached to one end of said at least one locator plate such that both of said locator plates lie in the same plane, at least one of said locator plates being attached to said backing member to form a T-shaped assembly.

2. A locator device for marking the proper position for securing the leaves of a hinge to and between opposable surfaces, which surfaces are to be made hingably movable relative to one another, said device comprising first, second and third locator plates, each of said plates being relatively flat and having two oppositely facing, broad flat surfaces, said plates being disposed in the same plane and being connected to one another on corresponding end portions thereof to form a multiple plate assembly such that said plates are rotationally displaced from one another in said plane, a first set of at least two sharp pins of predetermined spacing and arrangement affixed to each of said locator plates and extending at right angles from corresponding ones of said oppositely facing surfaces for marking the location of fasteners for one of two leaves of up to three different hinges, a second set of at least two sharp pins of predetermined spacing and arrangement affixed to each of said locator plates and extending at right angles from the other of said oppositely facing surfaces for marking the location of fasteners for another of the two leaves of up to three different hinges, a backing member having a broad, flat backing surface which lies in a plane which is perpendicular to the plane containing said assembly, and means for movably attaching said assembly to said backing member such that any one of said locator plates can be arranged in an operative position projecting perpendicular to said backing surface.

3. The locator device of claim 2 wherein said plates are rotationally displaced from one another by approximately 120 degrees of arc.

4. A locator device for marking the proper position for securing the leaves of a hinge to and between opposable surfaces, which surfaces are to be made hingably movable relative to one another, said device comprising a first hinge leaf locator plate of a preselected size and shape having first and second oppositely facing broad, flat surfaces, a second hinge leaf locator plate of a preselected size and shape having first and second oppositely facing broad, flat surfaces, a third hinge leaf locator plate of a preselected size and shape having first and second oppositely facing broad, flat surfaces, said first, second and third locator plates being disposed in the same plane and being connected to one another on corresponding end portions thereof to form a multiple plate assembly such that said plates are rotationally displaced from one another in said plane, an L-shaped backing member having a first leg parallel to said assembly and a second leg perpendicular to said first leg and to said assembly, a pivot pin fixedly attached on one end thereof to a central portion of said assembly, said first leg defining a hole therethrough through which said pin projects, said pin being both longitudinally and rotatably slidable in said hole, said pin containing a shouldered end cap on a free end thereof, a coiled spring disposed around said pin and confined in compression between said end cap and said first leg so as to bias said first leg toward said assembly, a first set of at least two sharp pins of predetermined spacing and arrangement mounted on and extending perpendicular to corresponding first broad surfaces of each of the locator plates, and a second set of at least two sharp pins of predetermined spacing and arrangement mounted on and extending perpendicular to corresponding second broad surfaces of each of said locator plates.

5. The locator device of claim 4 wherein each said plate is rotationally displaced from the other plates by 120 degrees of arc as measured in said plane.

6. The locator device of claim 4 further comprising a pair of spaced apart, cylindrically shaped locator tabs attached to said first leg and projecting toward said assembly, each of said assembly plates containing a circular opening which is sized to closely and slidably fit either one of said locator tabs, said tabs and openings being respectively spaced apart such that both of said tabs fit in a different one of said openings in two of said plates when the remaining one of said plates is disposed in an operative position relative to said backing member.

7. The locator device of claim 4 wherein the size of each of said locator plates is different from that of the remainder of said plates.

8. The locator device of claim 4 wherein the spacing of corresponding ones of said first and second sets is different from that of the remainder of corresponding ones of said first and second sets.

9. The locator device of claim 7 wherein the spacing of corresponding ones of said first and second sets is different from that of the remainder of corresponding ones of said first and second sets.

* * * * *

UNITED STATES PATENT AND TRADEMARK OFFICE

CERTIFICATE OF CORRECTION

PATENT NO. : 5,669,153

DATED : Sep. 23, 1997

INVENTOR(S) : Edward D. Hood

It is certified that error appears in the above-indentified patent and that said Letters Patent is hereby corrected as shown below:

Col. 3, line 26,
"ganged" should read --arranged--

Signed and Sealed this

Thirtieth Day of December, 1997

Bruce Lehman

*Attest:*

BRUCE LEHMAN

*Attesting Officer*

*Commissioner of Patents and Trademarks*